US005503482A

United States Patent [19]

Kawakami et al.

[11] Patent Number: 5,503,482

[45] Date of Patent: Apr. 2, 1996

[54] TAPE PRINTING APPARATUS

[75] Inventors: Yasushi Kawakami, Nagoya; Masaharu Mori, Anjo; Shoji Sakuragi, Nagoya; Minako Ishida, Ama; Kazuaki Koie, Tokoname; Sachiyo Nakahigashi, Nishikasugai; Kengo Omura, Toyoake, all of Japan

[73] Assignee: Brother Kogyo Kabushiki Kaisha, Nagoya, Japan

[21] Appl. No.: 357,924

[22] Filed: Dec. 16, 1994

[30] Foreign Application Priority Data

Dec. 29, 1993 [JP] Japan ..... 5-351252
Jan. 15, 1994 [JP] Japan ..... 6-015875

[51] Int. Cl.[6] ..... B41J 3/46

[52] U.S. Cl. ..... 400/83; 400/615.2

[58] Field of Search ..... 400/83, 615.2; 345/132; 395/102

[56] References Cited

U.S. PATENT DOCUMENTS 5,117,719 6/1992 Tagaki et al. ..... 83/640
5,188,469 2/1993 Nagao et al. ..... 400/615.2
5,253,334 10/1993 Kimura ..... 395/102
5,314,256 5/1994 Niwa ..... 400/61
5,351,064 9/1994 Zenda ..... 345/132
5,393,147 2/1995 Ueno et al. ..... 400/615.2

FOREIGN PATENT DOCUMENTS 0534794 3/1993 European Pat. Off. ..... 400/615.2

*Primary Examiner*—Edgar S. Burr
*Assistant Examiner*—Steven S. Kelley
*Attorney, Agent, or Firm*—Oliff & Berridge

[57] ABSTRACT

A tape printing apparatus for making printed labels includes a keyboard for entering a character string, a display screen for displaying the character string, a tape cassette printer mechanism for printing the character string on the tape, a tape width detector for detecting the tape width of the tape cassette mounted on the printer mechanism, a first display data generator which generates pattern image data used to define the effective display zone of display screen that is proportional to the detected tape width, and a second display data generator which generates image data of the entered character string based on stored font data so that a print image of the character string in correct proportion to the tape width is displayed in the display zone.

20 Claims, 29 Drawing Sheets

Fig.4

TB1

| CASSETTE SENSOR OUTPUT | TAPE WIDTH |
|---|---|
| 0000 | NO TAPE |
| 1010 | 6mm |
| 1000 | 9mm |
| 11XX | 12mm |
| 001X | 18mm |
| 01XX | 24mm |

REMARKS:
X TAKES "0" OR "1"

Fig.6

TB3

| TAPE WIDTH (mm) | PRINT ZONE (dots) | NUMBER OF LINES | PRINT CHARACTER SIZE (POINT VALUE: NUMBER OF DOTS) |
|---|---|---|---|
| 6 | 32 | 1 | 13pt:32 |
| | | 2 | 6pt:16 |
| 9 | 48 | 1 | 19pt:48 |
| | | 2 | 10pt:24 |
| | | 3 | 6pt:16 |
| 12 | 56 | 1 | 19pt:48 |
| | | 2 | 10pt:24 |
| | | 3 | 6pt:16 |
| 18 | 96 | 1 | 38pt:96 |
| | | 2 | 19pt:48 |
| | | 3 | 13pt:32 |
| | | 4 | 10pt:24 |
| | | 5 | 6pt:16 |
| 24 | 96 | 1 | 38pt:96 |
| | | 2 | 19pt:48 |
| | | 3 | 13pt:32 |
| | | 4 | 10pt:24 |
| | | 5 | 6pt:16 |

Fig.7

TB4

| PRINT CHARACTER SIZE (POINT VALUE) | DISPLAY CHARACTER SIZE (dots) | | |
|---|---|---|---|
| | NORMAL SCALE | ×2 | ×3 |
| 6 pt | 7 | 10 | 16 |
| 10 pt | 7 | 16 | 21 |
| 13 pt | 10 | 21 | 32 |
| 19 pt | 16 | 32 | —— |
| 26 pt | 21 | —— | —— |
| 38 pt | 32 | —— | —— |

TB5

| TAPE WIDTH (mm) | | DISPLAY ZONE WIDTH DATA (dots) | | |
|---|---|---|---|---|
| | | NORMAL SCALE | x2 | x3 |
| NO TAPE | UPPER CUTOFF ZONE WIDTH | 0 | 0 | 0 |
| | IMAGE DISPLAY ZONE WIDTH | 32 | 32 | 32 |
| | LOWER CUTOFF ZONE WIDTH | 0 | 0 | 0 |
| 6 | UPPER CUTOFF ZONE WIDTH | 8 | 3 | 0 |
| | IMAGE DISPLAY ZONE WIDTH | 16 | 26 | 32 |
| | LOWER CUTOFF ZONE WIDTH | 8 | 3 | 0 |
| 9 | UPPER CUTOFF ZONE WIDTH | 5 | 0 | 0 |
| | IMAGE DISPLAY ZONE WIDTH | 21 | 32 | 32 |
| | LOWER CUTOFF ZONE WIDTH | 6 | 0 | 0 |
| 12 | UPPER CUTOFF ZONE WIDTH | 4 | 0 | 0 |
| | IMAGE DISPLAY ZONE WIDTH | 24 | 32 | 32 |
| | LOWER CUTOFF ZONE WIDTH | 4 | 0 | 0 |
| 18 | UPPER CUTOFF ZONE WIDTH | 0 | 0 | 0 |
| | IMAGE DISPLAY ZONE WIDTH | 32 | 32 | 32 |
| | LOWER CUTOFF ZONE WIDTH | 0 | 0 | 0 |
| 24 | UPPER CUTOFF ZONE WIDTH | 0 | 0 | 0 |
| | IMAGE DISPLAY ZONE WIDTH | 32 | 32 | 32 |
| | LOWER CUTOFF ZONE WIDTH | 0 | 0 | 0 |
| REMARKS | | | | |

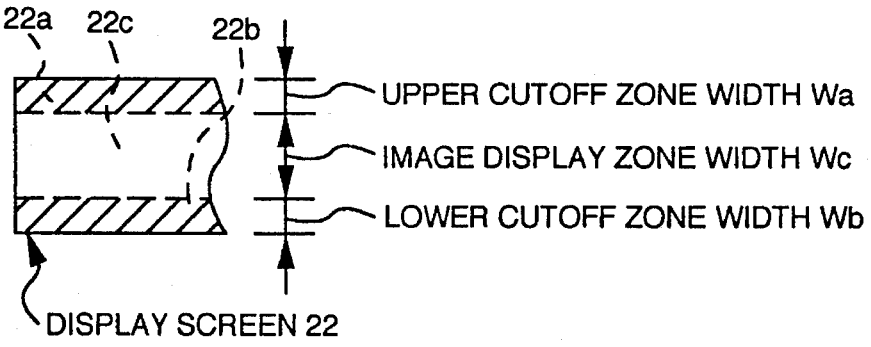

FIG. 8

Fig.9
TB6
| DISPLAY ZONE PATTERN No. P | CUTOFF ZONE DISPLAY MODE | APPEARANCE ON DISPLAY SCREEN |
|---|---|---|
| 1 | HATCHING | 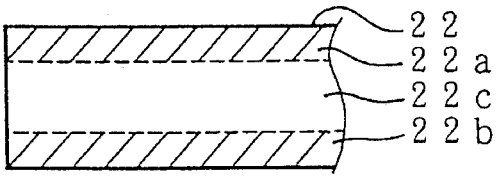  |
| 2 | SHADING | 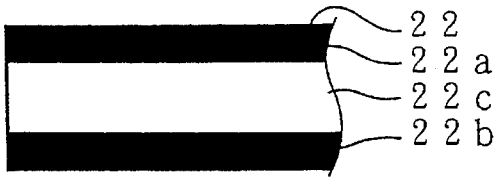  |
| 3 | DUAL-LINE BORDERS | 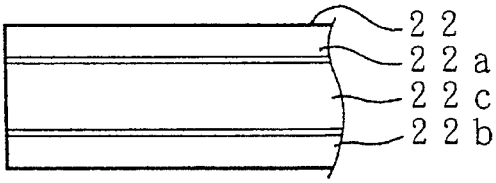  |
| 4 | DASHED-LINE BORDERS | 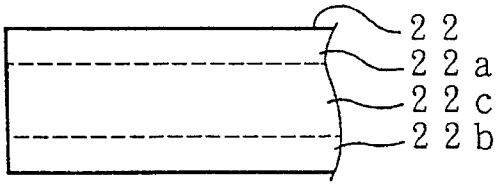  |
| 5 | SOLID-LINE BORDERS | 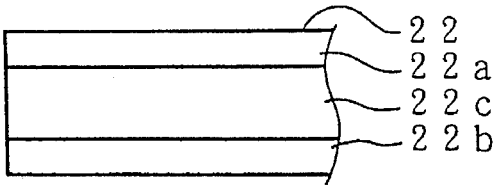  |

FIG. 10B

| STEP | ACTION |
|---|---|
| S1 | INITIALIZING PROCESS |
| S2 | READS CASSETTE SIGNAL, CALCULATES AND STORES TAPE WIDTH, AND CALCULATES IMAGE DISPLAY ZONE |
| S3 | LOADS DEFAULT FORMAT DATA IN TEXT MEMORY |
| S4 | TEXT ENTRY SCREEN DISPLAY PROCESS |
| S5 | PRINT IMAGE DISPLAY PROCESS |
| S6 | ANY KEY OPERATION ? |
| S7 | DISPLAY SIZE SET KEY ? |
| S8 | DISPLAY SIZE SETTING PROCESS |
| S9 | DISPLAY ZONE ALTER KEY ? |
| S10 | DISPLAY ZONE ALTERATION PROCESS |

FIG. 11B

| STEP | ACTION |
|---|---|
| S11 | FORMAT SET KEY ? |
| S12 | FORMAT DATA SETTING PROCESS |
| S13 | TEXT ENTER KEY ? |
| S14 | TEXT DATA STORING PROCESS ? |
| S15 | PRINT KEY ? |
| S16 | TAPE PRINTING PROCESS |
| S17 | PROCESS RELEVANT TO OPERATED KEY |

FIG. 12B

| STEP | ACTION |
|---|---|
| | START TEXT ENTRY SCREEN DISPLAY ROUTINE |
| S20 | READS TAPE WIDTH, DISPLAY SCALE FACTOR R & DISPLAY ZONE PATTERN NUMBER P |
| S21 | CALCULATES CUTOFF ZONE WIDTH Wa & Wb USING TB5 |
| S22 | GENERATES DISPLAY DOT PATTERN DATA OF CUTOFF ZONES AND LOADS THE DATA TO WORKING MEMORY |
| S23 | DEVELOPS DISPLAY DOT PATTERN DATA IN DISPLAY DATA BUFFER |
| S24 | DELIVERS DISPLAY IMAGE DATA |
| | RETURN |

FIG. 13B

| STEP | ACTION |
|---|---|
| | START PRINT IMAGE DISPLAY ROUTINE |
| S30 | SEARCHES TEXT MEMORY, CREATES LAYOUT DATA, AND STORES THE DATA |
| S31 | PARAMETER INITIALIZING PROCESS<br>SP ← START ADDRESS, EP ← END ADDRESS + 2, DC ← 0 |
| S32 | READ OUT DATA AT ADDRESS SP+(DCx2) |
| S33 | FORMAT DATA ? |
| S34 | LOADS THE DATA TO WORKING MEMORY |
| S35 | CHARACTER FOR PRINTING ? |
| S36 | DISPLAY IMAGE GENERATION PROCESS |
| S37 | DC ← (DC+1) |
| S38 | SP + (DCx2) = EP |
| S39 | DELIVERS DISPLAY DOT IMAGE DATA |
| | RETURN |

FIG. 14B

| STEP | ACTION |
|---|---|
| | START DISPLAY IMAGE GENERATION ROUTINE |
| S50 | CALCULATES DISPLAY CHARACTER SIZE FROM PRINT CHARACTER SIZE & DISPLAY SCALE FACTOR |
| S51 | FETCHES INDEX ADDRESS OF DISPLAY CHARACTER SIZE USING SEARCH TABLE |
| S52 | FETCHES FONT MEMORY ADDRESS OF CHARACTER BASED ON INDEX ADDRESS |
| S53 | LOADS DISPLAY DOT PATTERN DATA IN WORKING MEMORY |
| S54 | LOADS DOT PATTERN DATA IN WORKING MEMORY TO DISPLAY DATA BUFFER |
| | RETURN |

FIG. 15B

| STEP | ACTION |
|---|---|
| | START DISPLAY SIZE SETTING ROUTINE |
| S60 | 6-mm TAPE ? |
| S61 | SCALE FACTOR R ← R+1 |
| S62 | R = 4 ? |
| S63 | R ← 1 |
| S64 | 9-mm TAPE ? |
| S65 | SCALE FACTOR 4 ← R+1 |
| S66 | R = 3 ? |
| S67 | R ← 1 |
| S68 | SCALE FACTOR R ← 1 |
| S69 | STORE R IN DISPLAY SCALE FACTOR MEMORY |
| S70 | DISPLAY ZONE ALTERATION PROCESS |
| | RETURN |

FIG. 16B

| STEP | ACTION |
|---|---|
| | START DISPLAY ZONE ALTERATION ROUTINE |
| S80 | P ← P + 1 |
| S81 | P = 6 ? |
| S82 | P ← 1 |
| S83 | LOADS DISPLAY ZONE PATTERN NUMBER P TO PATTERN MEMORY |
| S84 | READS TAPE WIDTH, DISPLAY SCALE FACTOR R & ZONE PATTERN NUMBER P |
| S85 | CALCULATES WIDTHS Wa & Wb USING TB5 |
| S86 | CREATES DISPLAY DOT PATTERN DATA OF CUTOFF ZONES AND LOADS THE DATA IN WORKING MEMORY |
| S87 | DEVELOPS DISPLAY DOT PATTERN DATA IN DISPLAY DATA BUFFER |
| | RETURN |

FIG. 17B

| STEP | ACTION |
|---|---|
| | START INTERRUPT ROUTINE |
| S90 | READS CASSETTE SIGNAL & KEY OPERATION SIGNAL |
| S91 | CALCULATES TAPE WIDTH |
| S92 | TF = 0 ? |
| S93 | TAPE WIDTH CHANGED ? |
| S94 | TF ← 1 |
| S95 | ANY KEY OPERATION ? |
| S96 | LOADS TAPE WIDTH DATA AND CALCULATES IMAGE DISPLAY ZONE |
| S97 | ALTERS PRINT CHARACTER SIZE SZ |
| S98 | ANY FORMAT DATA ALTERED ? |
| S99 | NUMBER OF PRINT LINES & PRINT CHARACTER SIZE APPLICABLE ? |
| S100 | DISPLAY ZONE ALTERATION PROCESS |
| S101 | TF ← 0 |
| S102 | ACTIVATES ALARM BUZZER |
| S103 | DISPLAY MESSAGE |
| | RETURN |

TAPE PRINTING APPARATUS

BACKGROUND OF THE INVENTION

The invention relates to a tape printing apparatus for printing alphanumeric and symbolic characters on a tape as a printing medium, and particularly to a tape printing apparatus having an improved print image display function.

The applicant of the invention has developed a tape printing apparatus having a keyboard, display screen and print mechanism for printing alphanumeric and symbolic characters on tapes having widths of, for example of 6, 9, 12, 18 and 24 mm, for making spine labels for files or the like, and proposed various editing functions be provided for the tape printing apparatus, as described in U.S. Pat. No. 5,117,719 and U.S. Pat. No. 5,314,256 (European Unexamined Patent Publication No. 0534794 A2), the disclosures of which are herein incorporated by reference.

The above-mentioned tape printing apparatus can deal with various tape widths by the use of exchangeable tape cassettes and characters are printed in sizes which are appropriate to the tape widths.

Conventional tape printing apparatuses are designed to display a print image of characters in a size which is set regardless of the tape width. Therefore it is difficult for the user to anticipate the print result of the tape based on the displayed print image.

A conceivable manner of overcoming this problem is to display a print range with border lines indicative of the tape width. However, such lines will not clearly indicate the tape width and will mix with entered characters such as frame line segments if the line type is fixed to a solid line, dashed line or dash-dot line for example.

SUMMARY OF THE INVENTION

An object of the invention is to provide a tape printing apparatus which enables the user to anticipate the print result of characters in relation to the tape width and operates to display distinctively on the display screen an area which represents the tape.

The invention resides in a tape printing apparatus that comprises an input means for entering alphanumeric and symbolic characters and various commands, data memory means for storing data of entered characters, display means including a display screen for displaying characters, font memory means for storing dot pattern data of many characters, a display data buffer for storing image data to be displayed on the display screen, display control means for controlling the display means in response to display of the image data read out of the display data buffer, printing means for printing characters on a tape as a printing medium, and a tape cassette which is mounted detachably on the printing means, wherein the apparatus further includes tape width detection means for detecting the tape width of the tape cassette, first display data generation means which receives data of the tape width detected by the tape width detection means, generates display image data for displaying distinctively an upper cutoff zone and lower cutoff zone in the upper and lower end sections of the display screen thereby to set up an effective display zone having a width proportional to the tape width in the central portion of the display screen, and develops the image data in the display data buffer, and a second data generation means which reads dot pattern data out of the font memory means for the characters held in the data memory means, generates display image data for displaying a print image of the characters in the effective display zone, and develops the image data in the display data buffer.

The first display data generation means may be designed to generate display image data for displaying the upper cutoff zone and lower cutoff zone in the form of hatched or shaded areas.

The first display data generation means may be designed to generate display image data for displaying the upper cutoff zone and lower cutoff zone in the form of border lines.

The apparatus may include line-type setting means for setting the type of border lines.

The first-mentioned tape printing apparatus includes input means, data memory means, display means including a display screen, font memory means, a display data buffer, display control means, printing means for printing characters on a tape, and a tape cassette which is mounted detachably on the printing means. The tape width detection means detects the tape width of the tape cassette. The first display data generation means receives data of the detected tape width, generates display image data for displaying distinctively an upper cutoff zone and lower cutoff zone in the upper and lower end sections of the display screen thereby to set up an effective display zone having a width proportional to the tape width in the central portion of the display screen, and develops the image data in the display data buffer. The second data generation means reads dot pattern data out of the font memory means for the characters held in the data memory means, generates display image data for displaying a print image of the characters in the effective display zone, and develops the image data in the display data buffer. Accordingly, the upper cutoff zone and lower cutoff zone are displayed distinctively in the upper-end and lower-end sections of the display screen so that the effective display zone proportional to the tape width is defined by the upper and lower cutoff zones and the characters read out of the data memory means are displayed with the same appearance as the print image.

In the second-mentioned tape printing apparatus, the first display data generation means generates display image data for displaying the upper cutoff zone and the lower cutoff zone in the form of hatched or shaded areas and the cutoff zones are displayed on the display screen.

In the third-mentioned tape printing apparatus, the first display data generation means generates display image data for displaying the upper cutoff zone and lower cutoff zone in the form of border lines and the border lines are displayed on the display screen.

In the fourth-mentioned tape printing apparatus, the form of border lines can be set by the line-form setting means.

BRIEF DESCRIPTION OF THE DRAWINGS

FIG. 4 is a table containing the correspondence between the cassette signal and tape width;

FIG. 6 is a table containing preset relationships between the tape width, number of print lines and print character size;

FIG. 7 is a table containing a preset relationship between the print character size and display character size;

FIG. 8 is a table containing a preset relationship between the tape width and the display zone width;

FIG. 9 is a table containing the display zone pattern number, display mode and appearance on the display screen;

FIG. 10B is a table of labels for FIG. 10A;

FIG. 11B is a table of labels for FIG. 11A;

FIG. 12B is a table of labels for FIG. 12A;

FIG. 13B is a table of labels for FIG. 13A;

FIG. 14B is a table of labels for FIG. 14A;

FIG. 15B is a table of labels for FIG. 15A;

FIG. 16B is a table of labels for FIG. 16A;

FIG. 17B is a table of labels for FIG. 17A;

DESCRIPTION OF THE PREFERRED EMBODIMENT

An embodiment of the invention will be described with reference to the drawings. This embodiment is the application of the invention to a tape printing apparatus operative to print alphabetic, numeric and symbolic characters on a tape.

Figure 1:
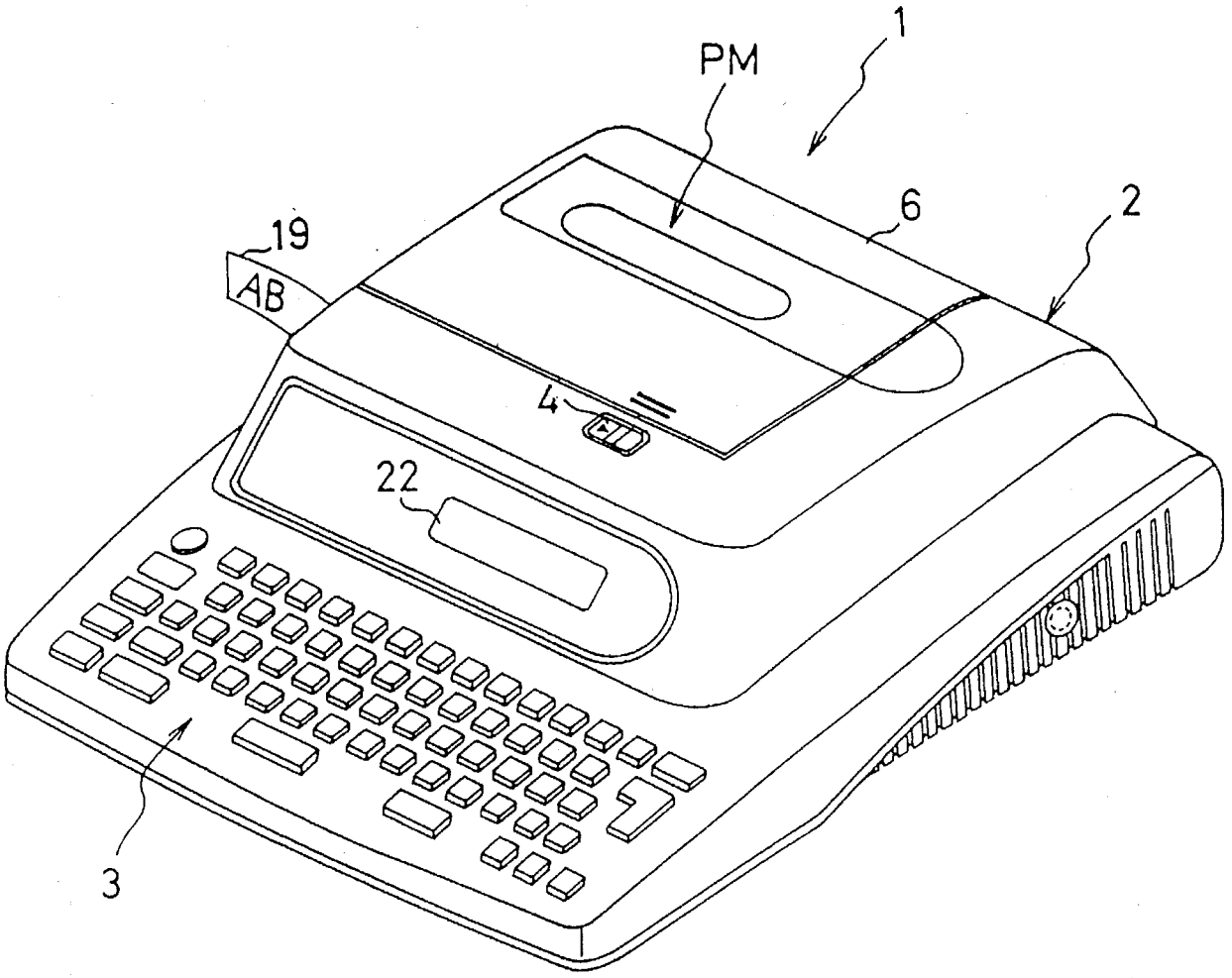
FIG. 1 is a perspective view of the tape printing apparatus.

As shown in FIG. 1, the tape printing apparatus 1 includes a keyboard 3 located in the front section of the main frame 2, a printing mechanism PM located inside of the main frame 2, and a liquid crystal display device 22 located above the keyboard 3. The display device 22 forms a display screen, consisting of 32-by-121 dots vertically and horizontally, on which entered characters are displayed in the form of a print image. A top cover 6 is opened by sliding a release button 4 for mounting or demounting a tape cassette CS on the printing mechanism PM.

The keyboard 3 (as input means) includes character keys for entering alphabetic, numeric and symbolic characters; space key; carriage return (CR) key; cursor up/down/right/left keys; display size set key; format set key for setting or altering format information including character modifier, display character size and print character size; text enter key for completing the entry of a text; print key for initiating the print operation, and power key for turning on or off the power.

The printing mechanism PM (FIG. 2) has a detachable mount for a rectangular tape cassette CS. In tape cassette CS are rotatably supported a tape spool 8 on which a laminated film tape 7 is loaded; a ribbon supply spool 10 on which a print ribbon 9 is loaded; a takeup spool 11 on which used print ribbon 9 is wound; a supply spool 13 on which a dual-side sticking tape 12 having the same width as the film tape 7, with associated separation paper mounted on the outer side thereof, is wound; and a joining roller 14 which joins the dual-side sticking tape 12 to the laminated film tape 7.

At the position of the printing mechanism PM, where the laminated film tape 7 and print ribbon 9 coincide, there is disposed a thermal print head 15. A support member 18 is attached pivotally on the main frame 2. Supported rotatably on the support member 18 are a platen roller 16, which presses the laminated film tape 7 and print ribbon 9 onto the print head 15, and a feed roller 17 which presses the laminated film tape 7 and dual-side sticking tape 12 onto the joining roller 14 to complete a print tape 19. The thermal print head 15 has a vertical alignment of 128 heating elements.

Figure 2:
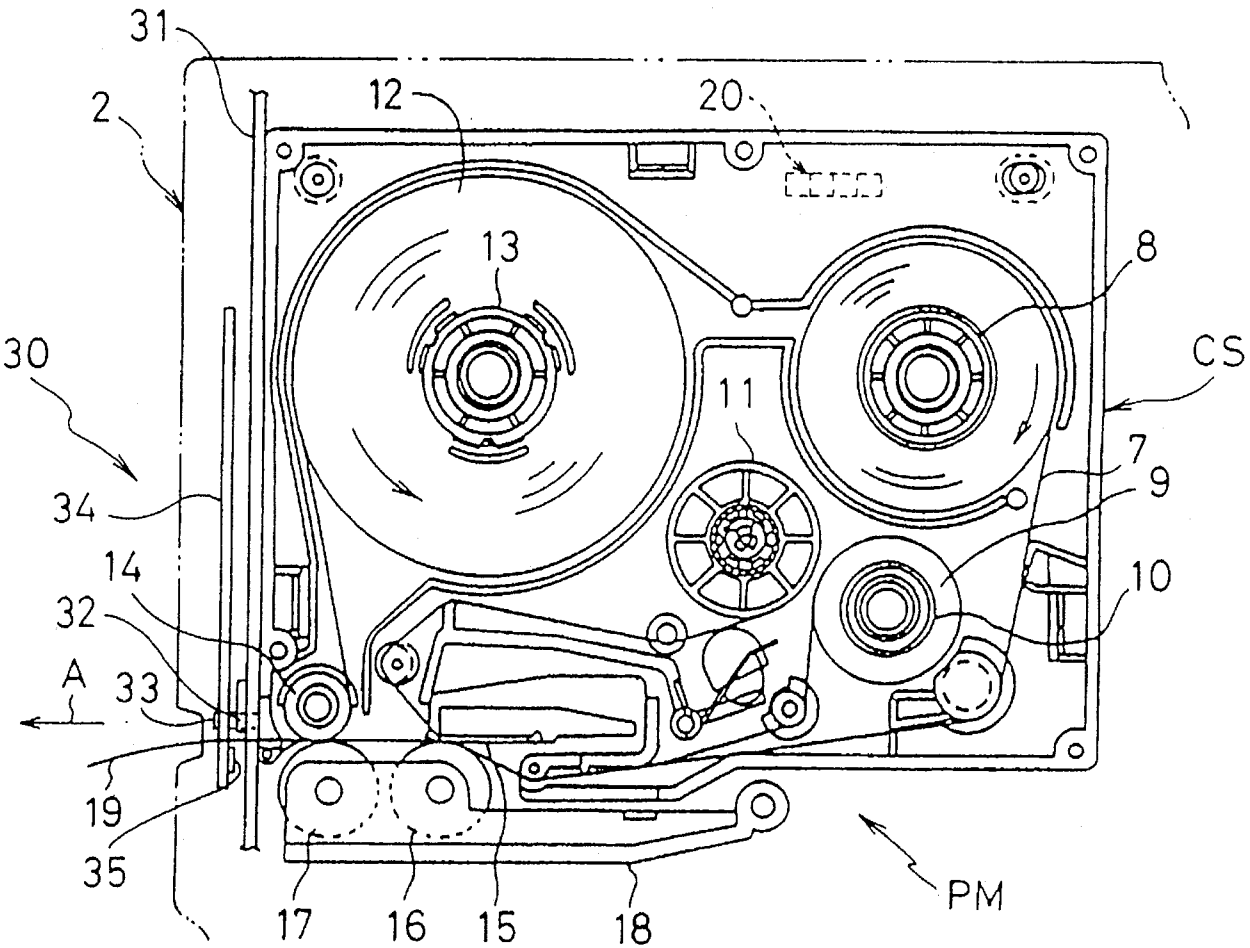
FIG. 2 is a plan view showing in brief the printing mechanism with a tape cassette being mounted on the printing mechanism.

In operation, a tape feed motor 45 (shown in FIG. 3) drives the joining roller 14 and takeup spool 11 synchronously in the specified direction as the heating elements of the print head 15 are energized selectively. Thus, the dot-matrix characters are printed on the laminated film tape 7. The print tape 19, i.e., the laminated film tape 7, with the dual-side sticking tape 12 adhered thereto, is transported in the direction indicated by the arrow "A". The print tape 19 is drawn out of the main frame 2 as shown in FIGS. 1 and 2. For a more detailed description of the printing mechanism PM, refer to U.S. Pat. No. 5,188,469, the disclosure of which is herein incorporated by reference.

Next, a print tape cutting device 30 will be explained in brief with reference to FIG. 2. Inside the main frame 2, there stands an subsidiary frame plate 31 in contact with the left-hand side of the tape cassette CS (as viewed by FIG. 2) and a fixed cutter 32 pointing upwardly is attached on it. An operation lever 34 extending in the depth direction is pivoted at the position near the front end thereof on a pivot 33 which is fixed in the lateral direction on the subsidiary frame plate 31, and a moving cutter 35 is attached on the operation lever 34 at the position in front of the pivot 33 to confront the fixed cutter 32. The operation lever 34 is linked at its rear end with a swing drive mechanism (not shown) which is in connection with a tape cutting motor 46 (shown in FIG. 3) so that it is driven by the motor 46 to swing vertically. Normally, the operation lever 34 is held so that the moving cutter 35 is away from the fixed cutter 32.

When the tape cutting motor 46 is activated by the cutting signal, causing the operation lever 34 to swing through the movement of the swing drive mechanism, the print tape 19, which has been printed by the print head 15, and is led out of the tape cassette CS and the main frame 2 through the gap between the fixed cutter 32 and moving cutter 35, is cut by the movement of the moving cutter 35 against the fixed cutter 32.

Five kinds of tape cassettes are available which provide print tapes having widths of 6, 9, 12, 18 and 24 mm. The kind of tape cassette is identified by a cassette sensor 42 (shown in FIG. 3) provided on the bottom of the main frame 2 through the detection of a combination of the presence and absence of four tabs 20 provided on the bottom of each tape cassette. The cassette sensor 42 produces a 4-bit cassette signal corresponding to the four tabs as shown in the table of FIG. 4. For example, the cassette sensor 42 produces a cassette signal of "0000" when no tape cassette is mounted on the apparatus.

Figure 3:
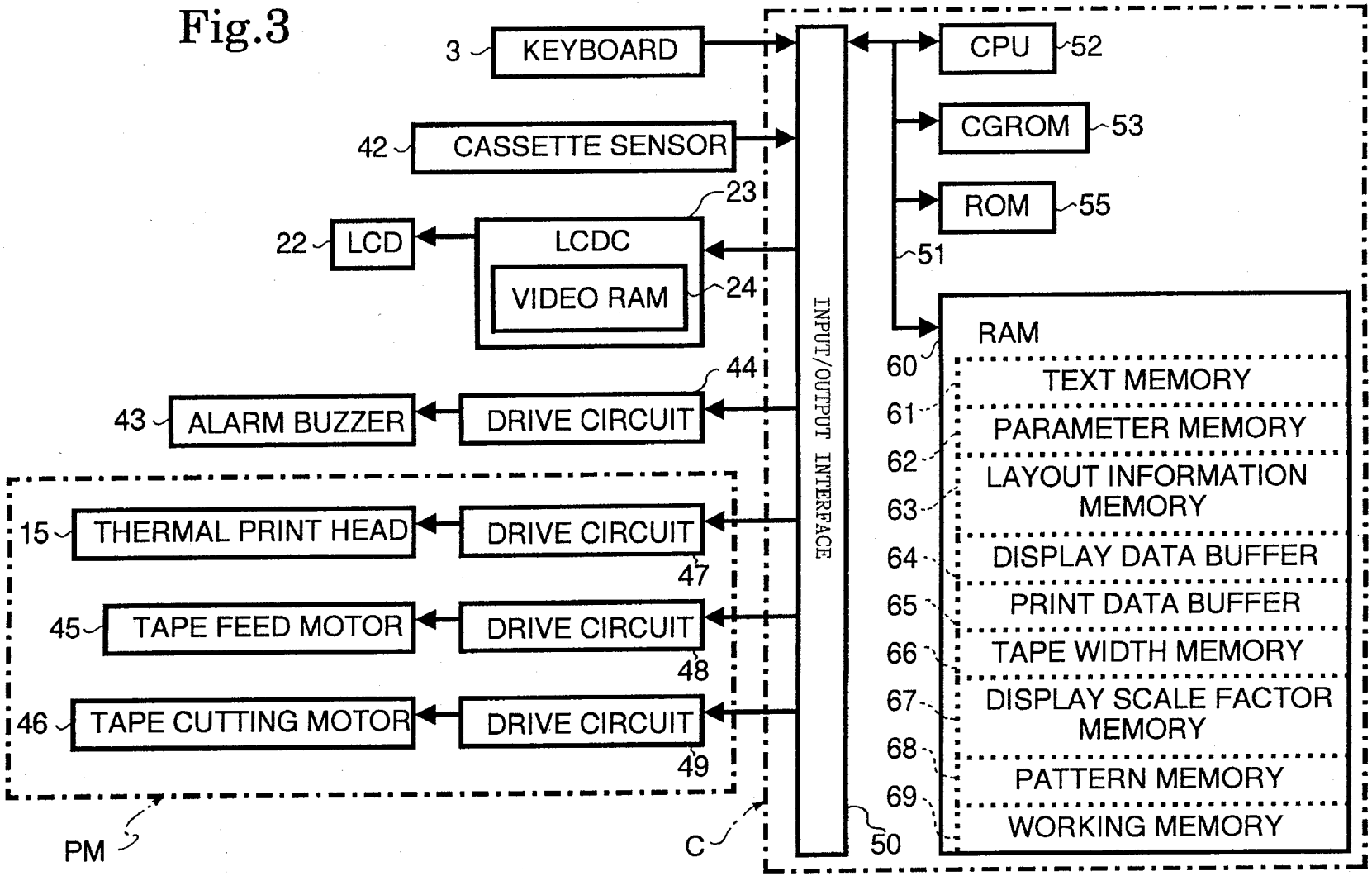
FIG. 3 is a block diagram of the control system of the tape printing apparatus.

The control system of the tape printing apparatus 1 will be explained with reference to FIG. 3.

The controller C includes a CPU 52, an input/output interface 50 which is connected to the CPU 52 through buses 51 including an address bus and data bus, a CGROM (character generator ROM) 53, a ROM 55, and a RAM 60. Connected externally to the interface 50 are the keyboard 3, the cassette sensor 42, a display controller (LCDC) 23 including a video RAM 24 which provides display data to the liquid crystal display screen (LCD) 22, a drive circuit 44 for an alarm buzzer 43, a drive circuit 47 for the thermal print head 15, a drive circuit 48 for the tape feed motor 45, and a drive circuit 49 for the tape cutting motor 46.

Figure 5:
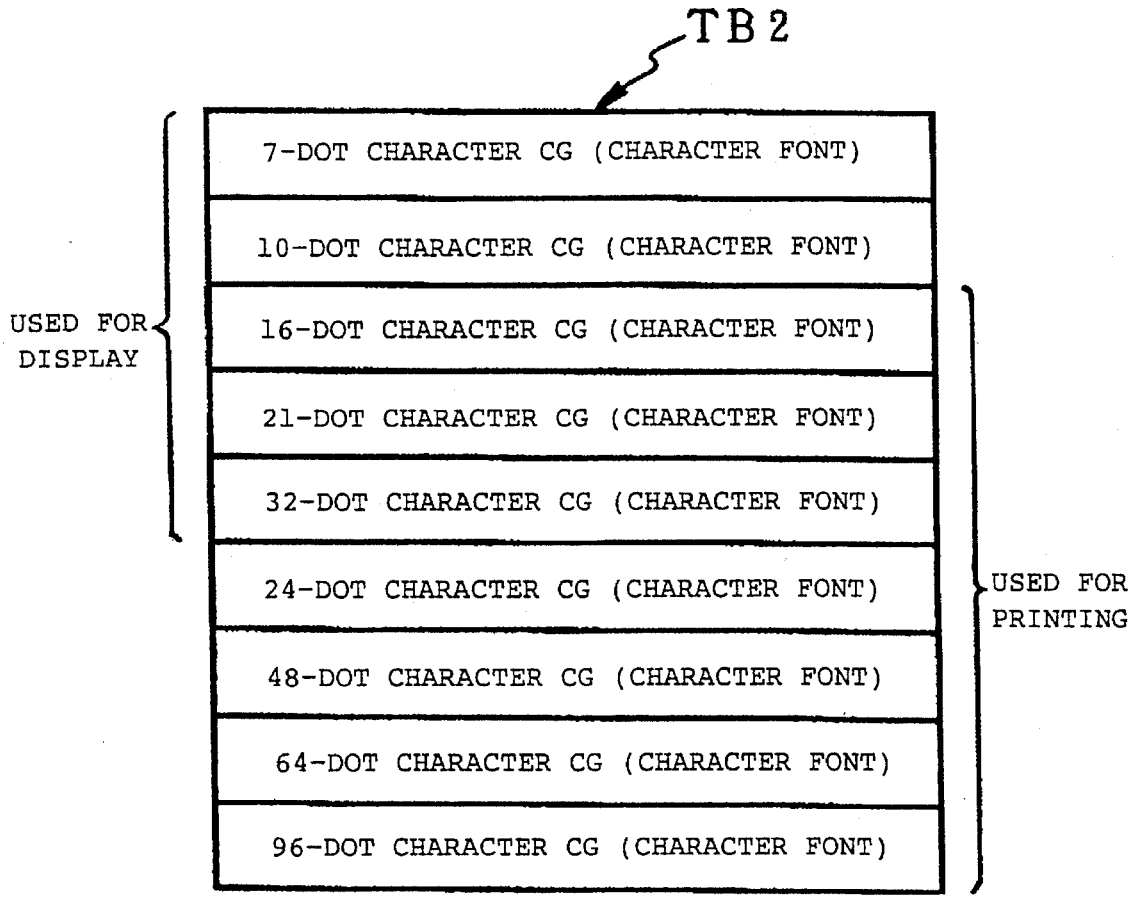
FIG. 5 is a table containing the character sizes of the character set stored in the CGROM.

The CGROM 53 stores dot pattern data as font data of alphabetic, numeric and symbolic characters of several types (such as Italic, Gothic) and nine sizes (7, 10, 16, 21, 24, 48, 64 and 96 dots) in correspondence to code data, as shown in FIG. 5. The ROM 55 stores a control program for displaying entered characters on the display screen 22 and printing the characters on the tape, a control program for reading data out of the print data buffer 66 sequentially and driving the print head 15 and tape feed motor 45, and tables TB1 and TB3–TB6 shown in FIG. 4 and FIGS. 6 through 9. The ROM 55 also stores a table TB2 which is a search table for indicating the correspondence between the nine character sizes and the starting addresses (index addresses) of the CGROM 53 of the dot pattern data. An index table (not shown), is provided for each size character which indicates the correspondence between the index addresses and the starting addresses of each character of that size, is also provided in the CGROM 53.

In the RAM 60, a text memory 61 holds text data which has been entered on the keyboard 3. A parameter memory 62 holds the value of the start address pointer SP indicative of the starting address of the text memory 61, the value of an end address pointer EP indicative of the ending address of the text memory 61, and the data count value DC. A layout information memory 63 stores information of the display position in the display data buffer 64 for the characters to be displayed.

A display data buffer 64 stores display dot image data which is the result of the merging of display dot pattern data of entered characters and a print data buffer 65 holds print dot image data which is the result of the merging of print dot pattern data of characters to be printed. A tape width memory 66 holds data of the tape width of the tape cassette CS determined from the cassette signal of the cassette sensor 42 based on the table TB1.

A display scale factor memory 67 holds data of the display scale factor R, which is initially R=i and can be revised later in response to the format altering operation with the display size set key. A pattern memory 68 holds data of the display zone patterns shown in FIG. 9. The RAM 60 also includes a working memory 69.

The table TB1, shown in FIG. 4, contains a preset relationship between the output signal of the cassette sensor 42 and the tape width of the tape cassette CS. It is accessed by the tape print control program. The table TB2, shown in FIG. 5, presents the character sizes of the character sets stored in the CGROM 53, the range of sizes applied to the display, and the range of sizes applied to the printing. The table TB3, shown in FIG. 6, contains a preset correspondence between the tape width, the print zone width in terms of the number of dots, the number of lines of characters and the print size of characters in terms of the point value and the number of dots. It is used to determine the print character size from the tape width and the number of lines.

The table TB4, shown in FIG. 7, contains a preset correspondence between the print character size (point value) and the display character size for each scale factor R (normal, 2X (2 times), 3X (3 times)). The print character size is determined from the tape width and the number of lines based on TB3 and the display character size is determined from the print character size and display scale factor R based on TB4.

The table TB5, shown in FIG. 8, contains a preset correspondence between the tape width, the display scale factor R, the width Wa of upper cutoff zone 22*a*, the width Wc of image display zone (effective display zone) 22*c*, and the width Wb of lower cutoff zone 22*b* of the display screen 22. As shown in the remarks of the table of FIG. 8, the image display zone 22*c* is the area where characters are displayed and its width Wc is dependent on the tape width. The upper cutoff zone 22*a* and lower cutoff zone 22*b* are excluded from the area for image display. The width of the image display zone 22*c* is generally enlarged proportional to the increase in tape width, causing the character size to increase. Consequently it becomes possible to display characters in the image display zone 22*c* with virtually the same appearance as the print image of the characters.

The table TB6, shown in FIG. 9, contains a preset of five display pattern modes used to display the upper and lower cutoff zones 22*a* and 22*b*. Pattern #1 is hatching applied to the cutoff zones 22*a* and 22*b*; pattern #2 is shading applied to the cutoff zones 22*a* and 22*b*; pattern #3 is a pair of dual lines drawn on the borders between the image display zone 22*c* and the upper and lower cutoff zones 22*a* and 22*b*; pattern #4 is a pair of dashed lines drawn on the borders between the image display zone 22*c* and the upper and lower cutoff zones 22*a* and 22*b*; and pattern #5 is a pair of solid lines drawn on the borders between the image display zone 22*c* and the upper and lower cutoff zones 22*a* and 22*b*.

The apparatus has an initial setting of pattern #1 that can be altered to any of the five pattern modes by the user.

Tape print control implemented by the controller C of the tape printing apparatus 1 will now be explained. Individual control routines will be explained with reference to the flowcharts of FIGS. 10A, 10B through 17A, 17B.

The main routine for tape print control commences after the power key on the keyboard 3 has been turned on. The memories 61–66 in the RAM 60 are cleared and the initializing process for the printing mechanism PM is carried out (Step 1 (S1)). The cassette signal from the cassette sensor 42 is read, the tape width is determined from the cassette signal based on the table TB1, the tape width data is loaded to the tape width memory 66, and the width Wc of the image display zone 22*c* is calculated from the tape width.

The default format data (the number of print lines, character size and character type) is loaded to the leading two bytes of the text memory 61 (S3). For example, "1" is set for the number of print lines, the print character size SZ is calculated based on the tape width and "1" print line using table TB3, and "Italic" is set for the character type.

Next, the text entry zone display routine for indicating the image display zone 22*c* based on the calculated size of Step S2 is executed. The process will be explained in detail with reference to the flowchart of FIGS. 12A, 12B. Data of the tape width, display scale factor R and pattern number P are read out of the memories 66, 67 and 68, respectively (S20). In the initial state, the values of R and P are both "1".

The cutoff widths Wa and Wb for the tape width are calculated based on the table TB5 (S21). Display dot pattern data for the cutoff zones 22*a* and 22*b* and the cursor K (shown in FIG. 19) are generated and loaded in the working memory 69 (S22). In this case, the size of the cursor K is set equal to the display character size which was determined based on the print character size determined from the tape width and "1" print line using table TB3 and from the normal display scale factor of R=1 using the table TB4.

Figure 19:
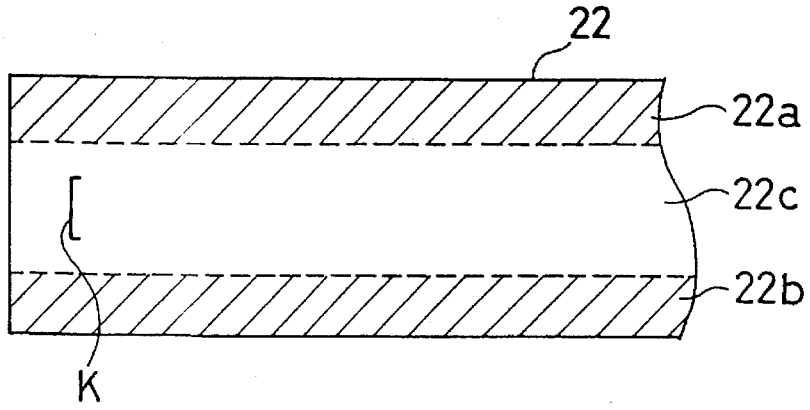
FIG. 19 is a diagram used to explain an example of a display of the text entry zone for the 6-mm tape width.
Figure 20:
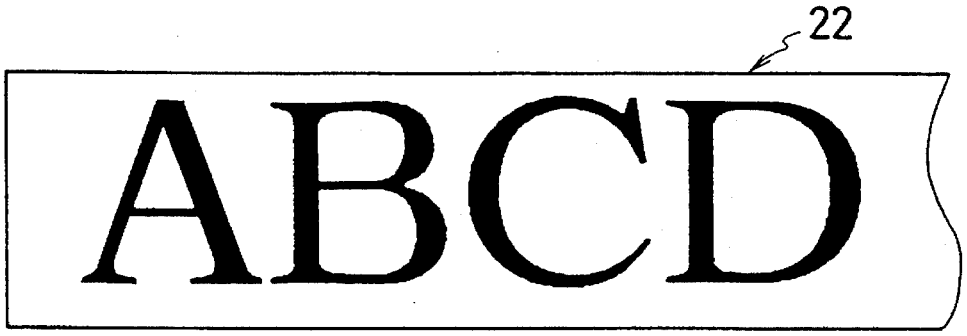
FIG. 20 is a diagram showing an example of a display for the 24-mm tape width.
Figure 21:
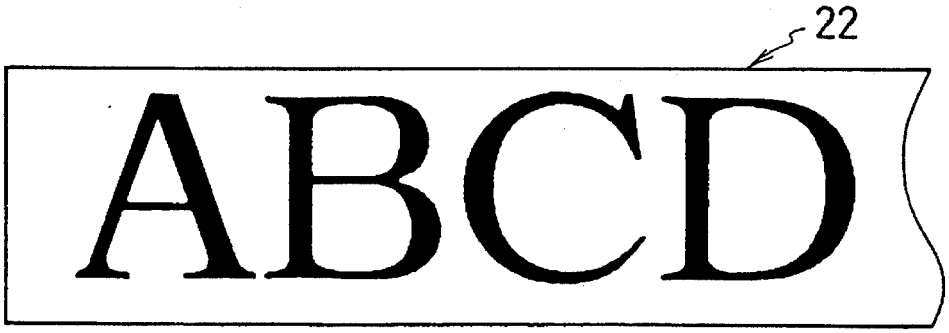
FIG. 21 is a diagram showing an example of a display for the 18-mm tape width.
Figure 22:
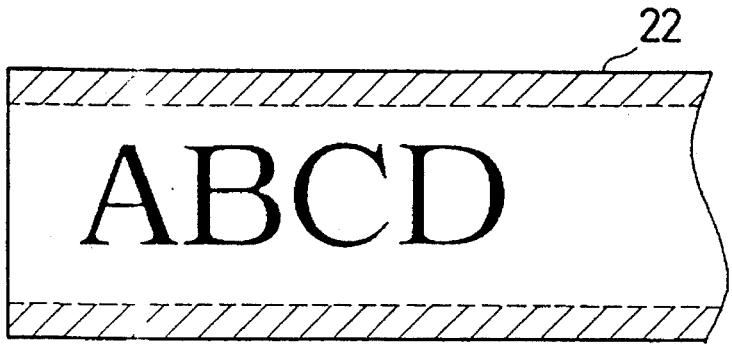
FIG. 22 is a diagram showing an example of a display for the 12-mm tape width.
Figure 23:
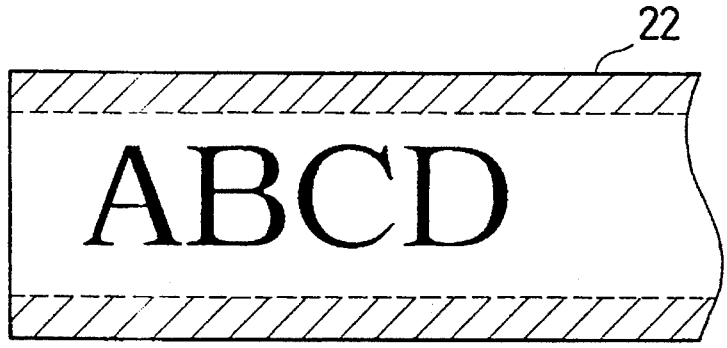
FIG. 23 is a diagram showing an example of a display for the 9-mm tape width.
Figure 24:
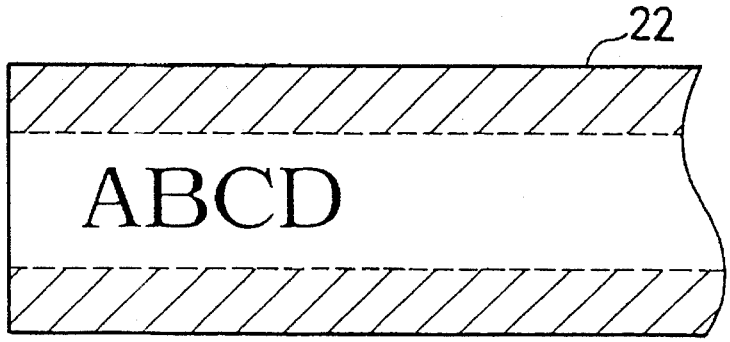
FIG. 24 is a diagram showing an example of a display for the 6-mm tape width.

Next, the display dot pattern data held in the working memory 69 is developed in the display data buffer 64 (S23). The developed display image data is read out of the display data buffer 64 into the video RAM 24 and displayed on the display screen 22 (S24). In the initial state, the cutoff zones 22*a* and 22*b* are displayed in the form of hatched areas on the display screen 22 in accordance with the pattern number of P=1, as shown in FIG. 19. Thereafter, the control sequence returns to the main routine.

Figure 10A:
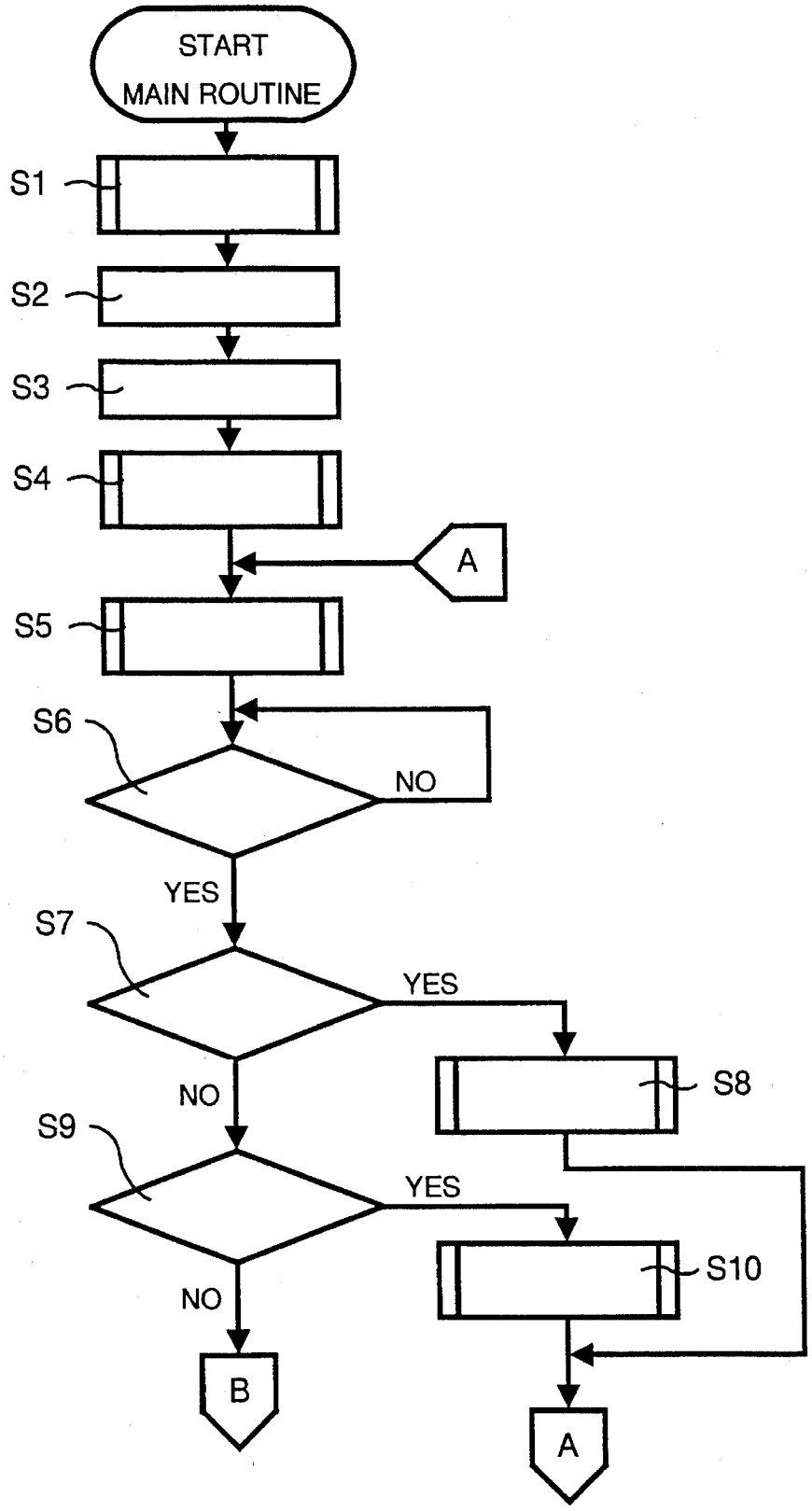
FIG. 10A is a flowchart showing the first part of the main routine of tape print control.
Figure 11A:
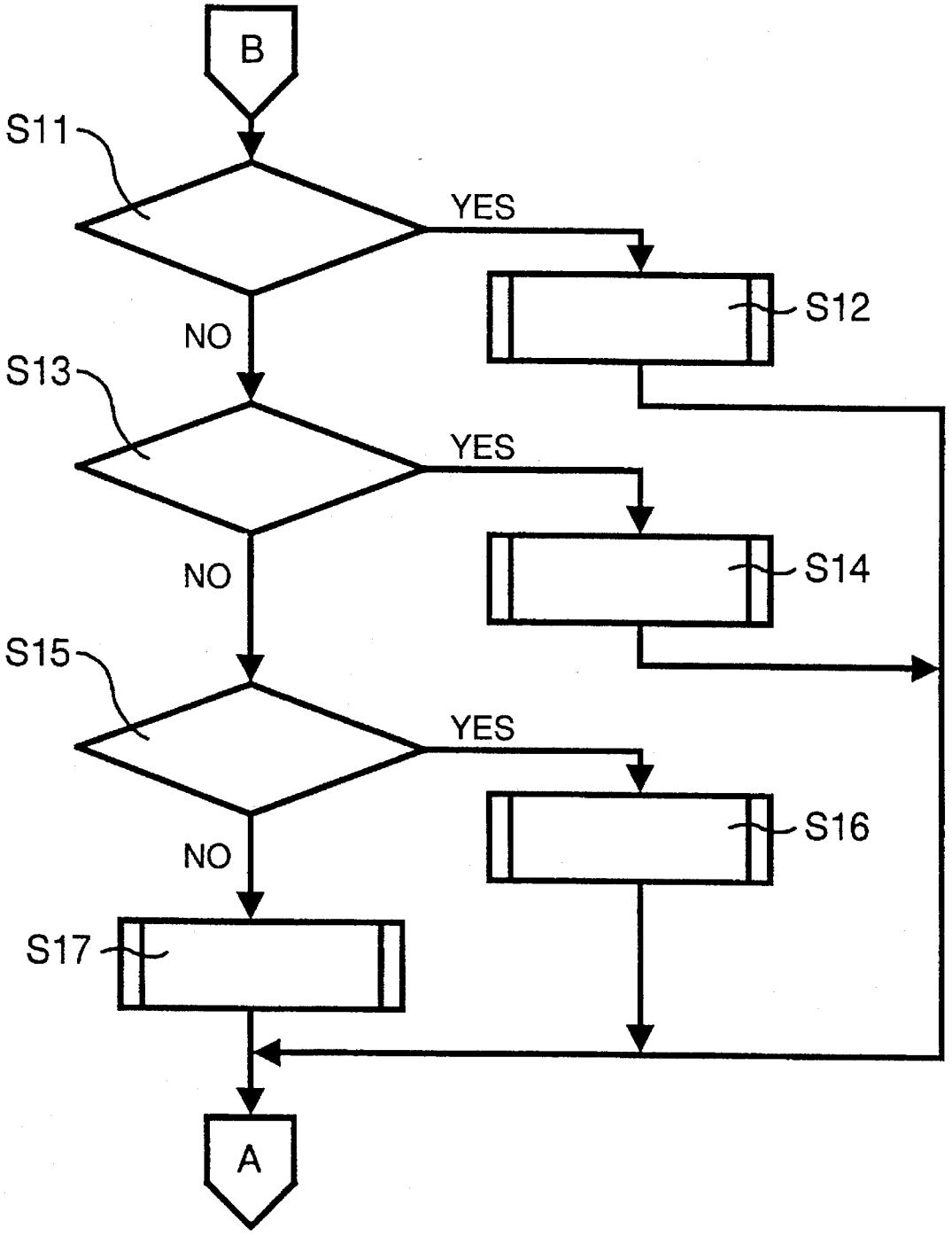
FIG. 11A is a flowchart showing the last part of the main routine of tape print control.
Figure 12A:
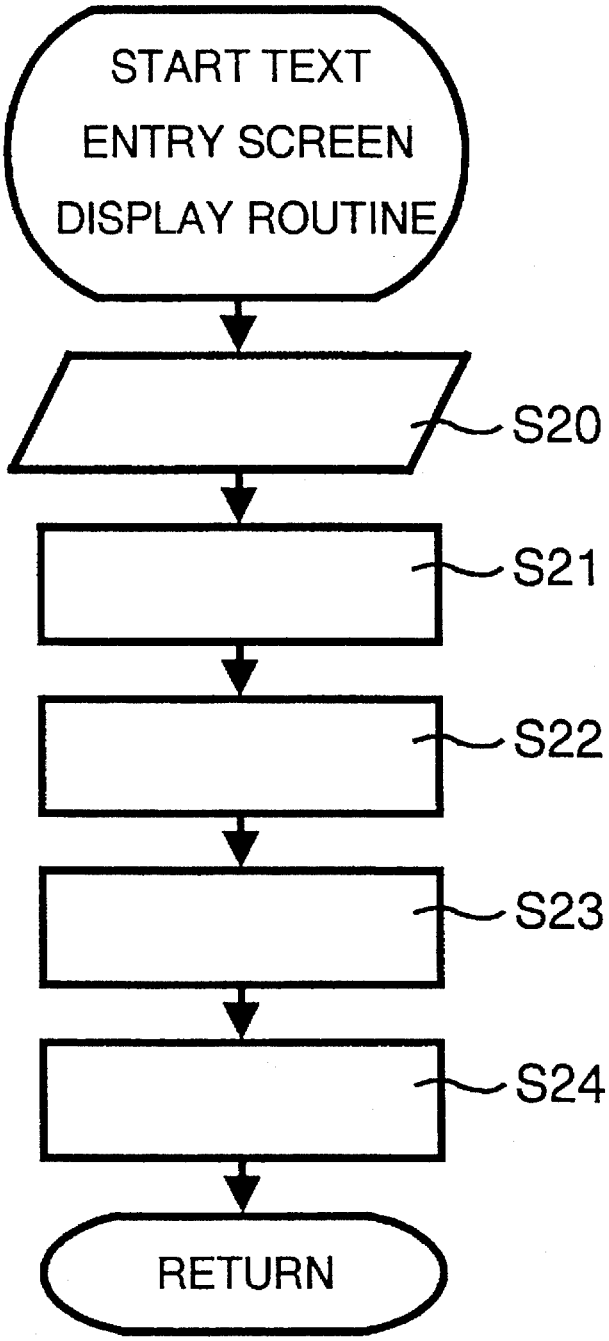
FIG. 12A is a flowchart of the text entry screen display routine shown in FIGS. 10A and 10B.
Figure 13A:
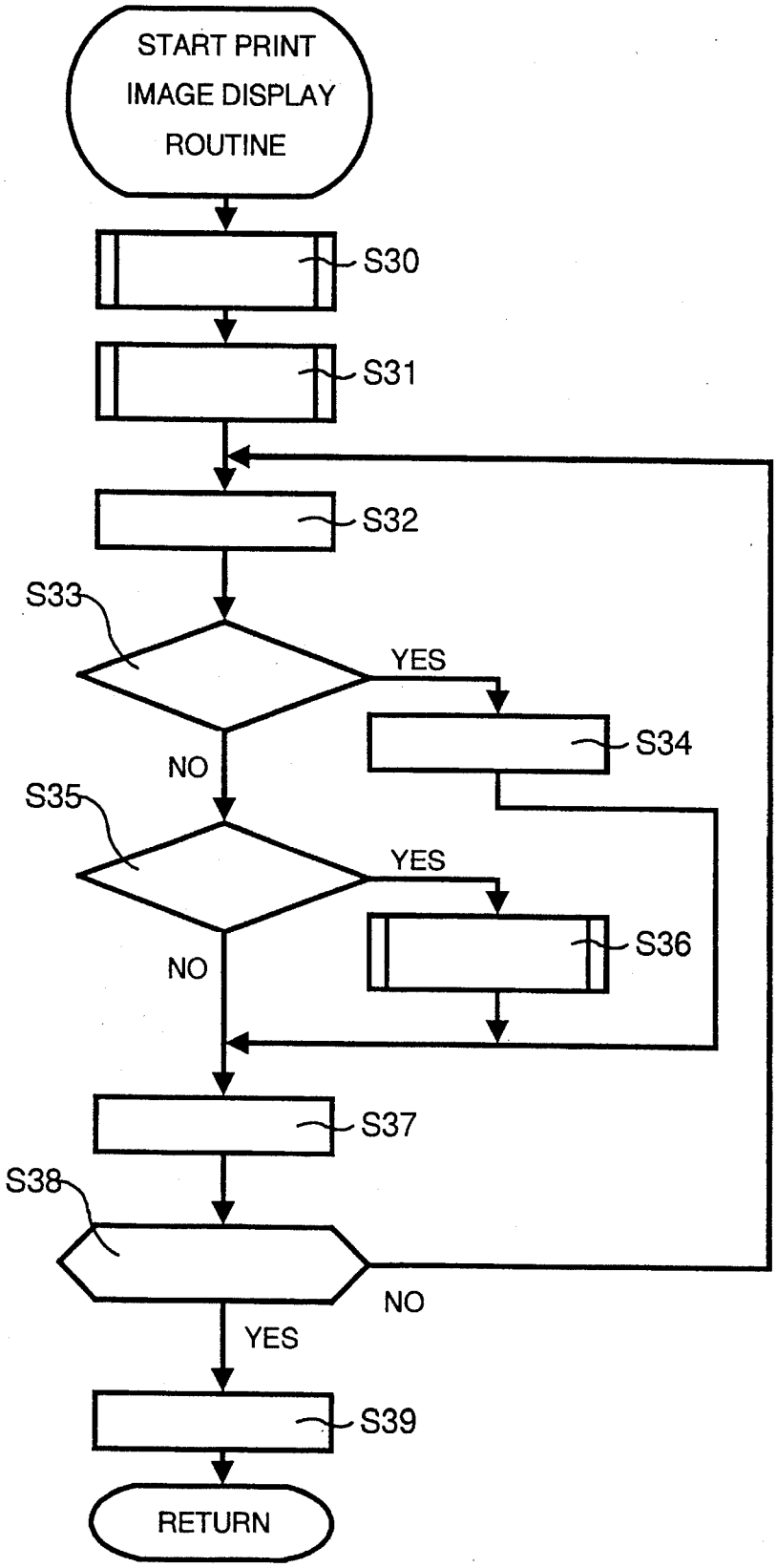
FIG. 13A is a flowchart of the print image display routine shown in FIGS. 10A and 10B.

On the flowchart of FIGS. 10A, 10B, the print image display routine for displaying the characters in the text memory 61 on the display screen 22 in the form of a print image is executed (S5). This routine will be explained later for ease of understanding.

The controller C senses the entry of key operation until the operation of some key is detected (S6). On detecting a key operation (S6: yes), the control sequence proceeds to Step S7. If operation of the display size set key is detected (S7: yes), the display size setting routine is executed (S8). This process will be explained with reference to the flowchart of FIGS. 15A, 15B.

Based on the data of the tape width and display scale factor R read out of the memories 66, 67, steps of judgement S60, S62, S64 and S66 are implemented. Specifically, when the tape width is 6 mm (S60: yes), the scale factor R is incremented by one (S61) and, if R reaches "4" (S62: yes), it is reset to "1" (S63). Namely, when the tape width is 6 mm, in which case the display character size at the normal scale factor is small and thus there is much room for scale-up display, the display scale factor R is switched such as from "1" to "2" to "3" and to "1", and it is loaded to the scale factor memory 67

When the tape width is 9 mm (S60: no, S64: yes), the scale factor R is incremented by one (S65) and, if R reaches "3" (S66: yes), it is reset to "1" (S67). Namely, when the tape width is 9 mm, in which case there is little room for scale-up display, the display scale factor R is switched such as from "1" to "2" and to "1" and it is loaded to the scale factor memory 67 (S69). For a tape width of 12 mm or greater (S60: no, S64: no), there is no room for scale-up display and the display scale factor R is fixed to the normal value "1" (S68).

After the display scale factor R has been loaded to the scale factor memory 67 (S69), the display zone alteration process (Steps 84–87 of FIGS. 16A, 16B) for changing the display image data for the cutoff zones 22*a*, 22*b* is carried out in response to a change in the display scale factor (S70) and the control sequence returns to Step 5 of the main routine. The display zone alteration routine will be explained later in connection with FIGS. 16A, 16B.

Figure 16A:
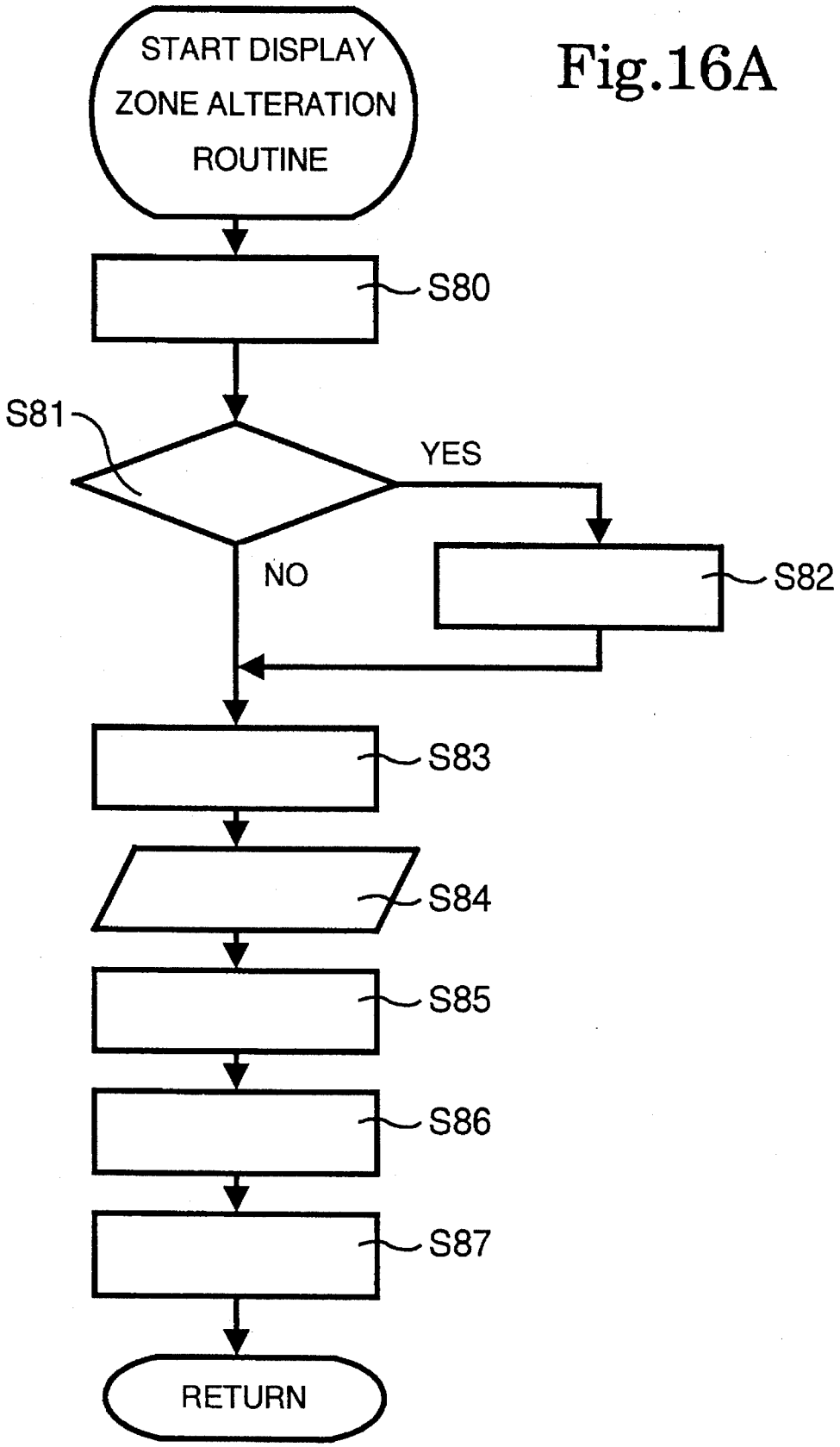
FIG. 16A is a flowchart of the display zone alteration routine shown in FIGS. 10A and 10B.

When the operation of the display zone alter key for changing the display of the cutoff zones 22*a*, 22*b* is detected by the main routine (S9: yes), the display zone alteration routine shown in FIGS. 16A, 16B is executed (S10). This process will be explained with reference to FIGS. 16A and 16B.

Initially, the pattern number P in the pattern memory 68 is incremented by one (S80). Whether P=6 is tested (S81), and the control sequence goes to Step 83 directly if P<6 (S81: no), or goes to Step 83 after resetting P=1 if P=6 (S81: yes). Namely, each time the display zone alter key is operated, the pattern number P is incremented by one to cycle such as from "1" to "2" to "3" to "4" to "5" and to "1."

Data of display zone pattern number P is loaded to the pattern memory 68 (S83). Subsequently, data of the tape width, display scale factor R, and pattern number P are read out of the memories 66, 67 and 68: (S84). The widths Wa and Wb of the cutoff zones 22*a* and 22*b* are calculated from the tape width based on the table TB5 (S85), display dot pattern data for the cutoff zones 22*a*, 22*b* are generated based on the values of Wa, Wb and P and the table TB6, and the pattern data is loaded to the working memory 69 (S86). The dot pattern data in the working memory 69 is developed in the display data buffer 64, and the image is displayed on the display screen 22. Thereafter, the control sequence returns to the main routine.

When the operation of the format set key is detected (S11: yes), the format data setting routine is executed (S12), and thereafter the control sequence returns to Step S5. In the format data setting routine, entries for the number of print lines, character size and character type are displayed on the display screen 22. The user uses the Cursor Move keys to select an entry, uses the numeric keys to enter an intended value and finally hits the text enter key. Then, the newly entered 2-byte format data is loaded as revised data next to the default format data in the text memory 61 as shown in FIG. 18, and the control sequence returns to Step 5.

When the operation of a character key (any of alphabetic, numeric and symbolic characters useful to create text for printing) is detected (S13: yes), the text data entry routine for storing code data of the character key in the text memory 61 is executed (S14). Thereafter, the control sequence returns to Step 5, and the print image display routine is executed (S5).

Figure 18:
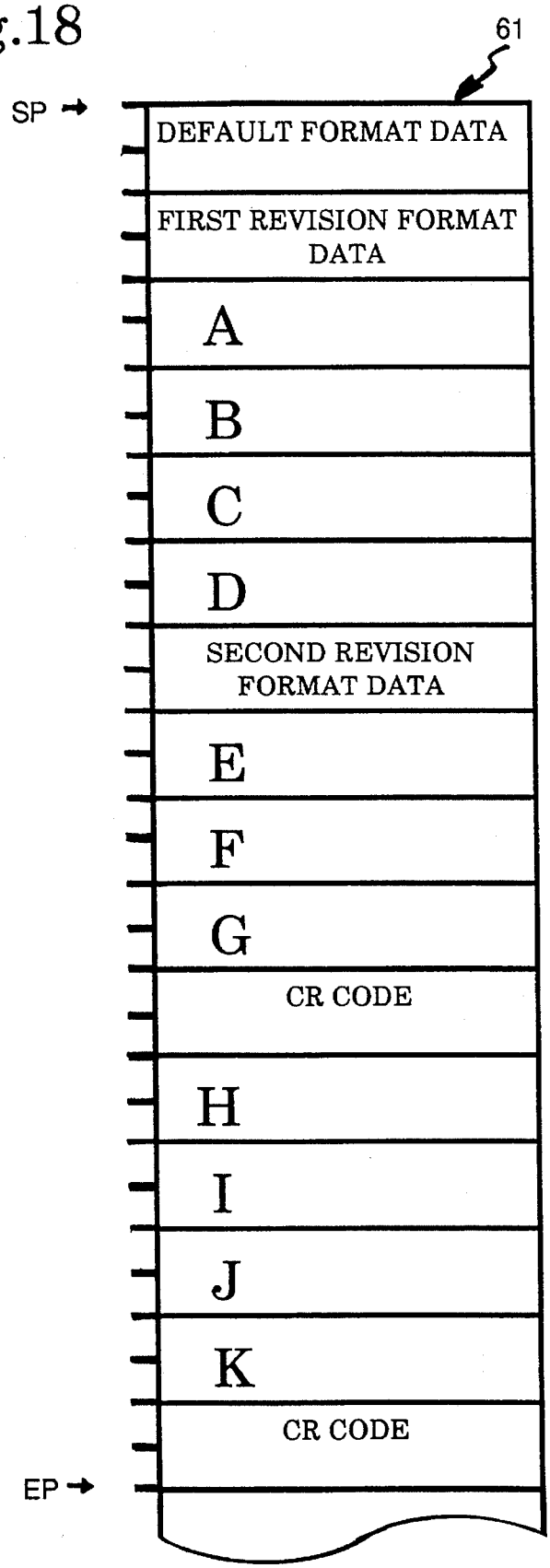
FIG. 18 is a diagram used to explain the text memory for storing format data and character codes.

The print image display routine will be explained with reference to FIGS. 13A, 13B and FIGS. 14A, 14B, on assumption that the text memory 61 already holds the default format data, first revision format data, characters "ABCD" second revision format data, characters "EFG" and so on, as shown in FIG. 18

Initially, character data is read out of the text memory 61 sequentially from the starting address and, for each character, layout information for developing the display dot pattern data in the display data buffer 64 is created based on the format data and CR code, and the layout information is loaded to the layout information memory 63 (S30). Specifically, the character print position for the character is first determined from the format data, CR code and print dot pattern data, and the coordinates of the print position are multiplied by a certain number (e.g., ⅓) to determine the display position of the character.

Subsequently, the initializing process for the printing parameters in the parameter memory 62 is carried out (S31).

Specifically, the starting address of the text memory 61 is set to the start address pointer SP of the parameter memory 62 (refer to FIGS. 14A, 14B), the next of the current ending address (ending address plus 2) of the text memory 61 is set to the end address pointer EP (refer to FIG. 18), and the data count value DC is initialized to "0".

Since the format data and character data have a 2-byte length, the data count value DC is doubled and added to the starting address to generate a search address and data is read out of the text memory 61 (S32). In the case of format data (S33: yes), it is loaded to the working memory 69 (S34), and thereafter the sequence proceeds to Step S37. In the case of character data inclusive of the space code (S33: no, S35: yes), the display image data generation routine is executed (S36) and thereafter the control sequence proceeds to Step S37.

The data count value DC is incremented by one (S37) and the Steps S32–S38 are repeated until the search address, i.e., the sum of the start address pointer SP and the doubled DC value, is equal to the end address pointer EP, indicative of the completion of printing for all characters in the text memory 61 (S38: yes).

Figure 14A:
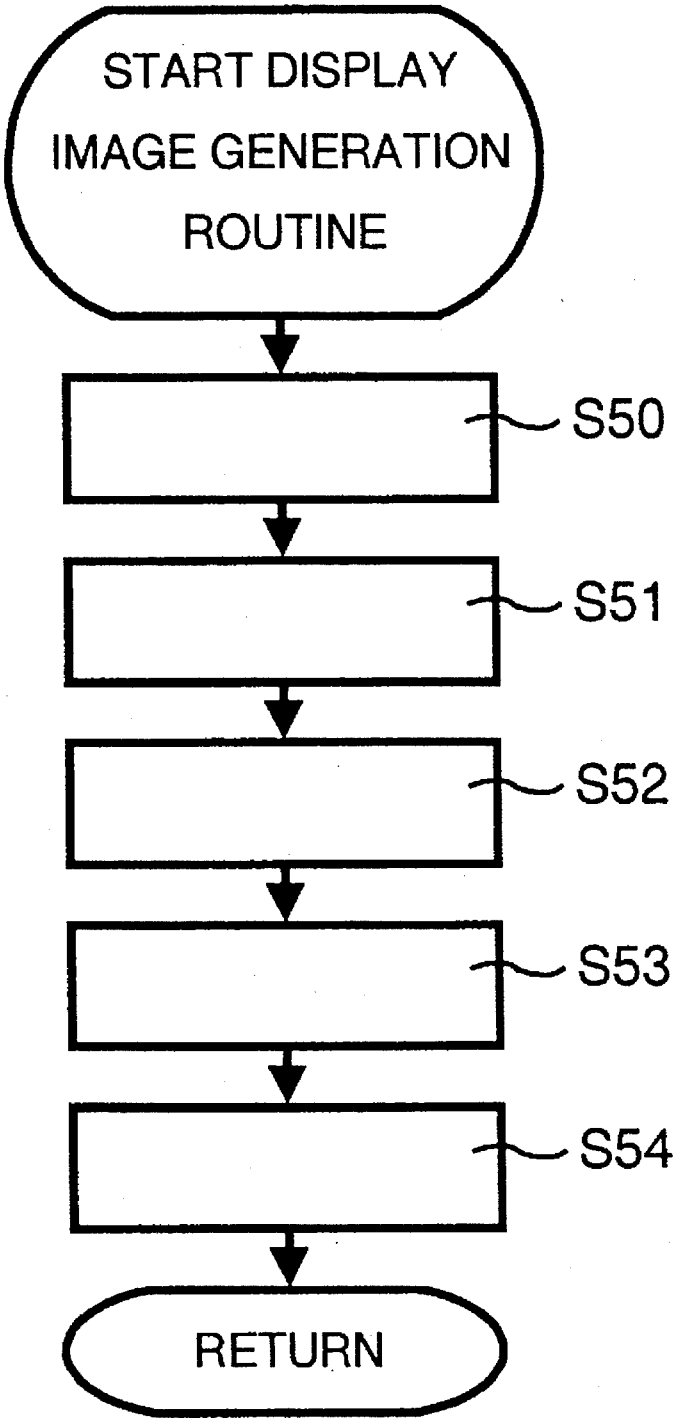
FIG. 14A is a flowchart of the display image generation routine shown in FIGS. 13A and 13B.
Figure 15A:
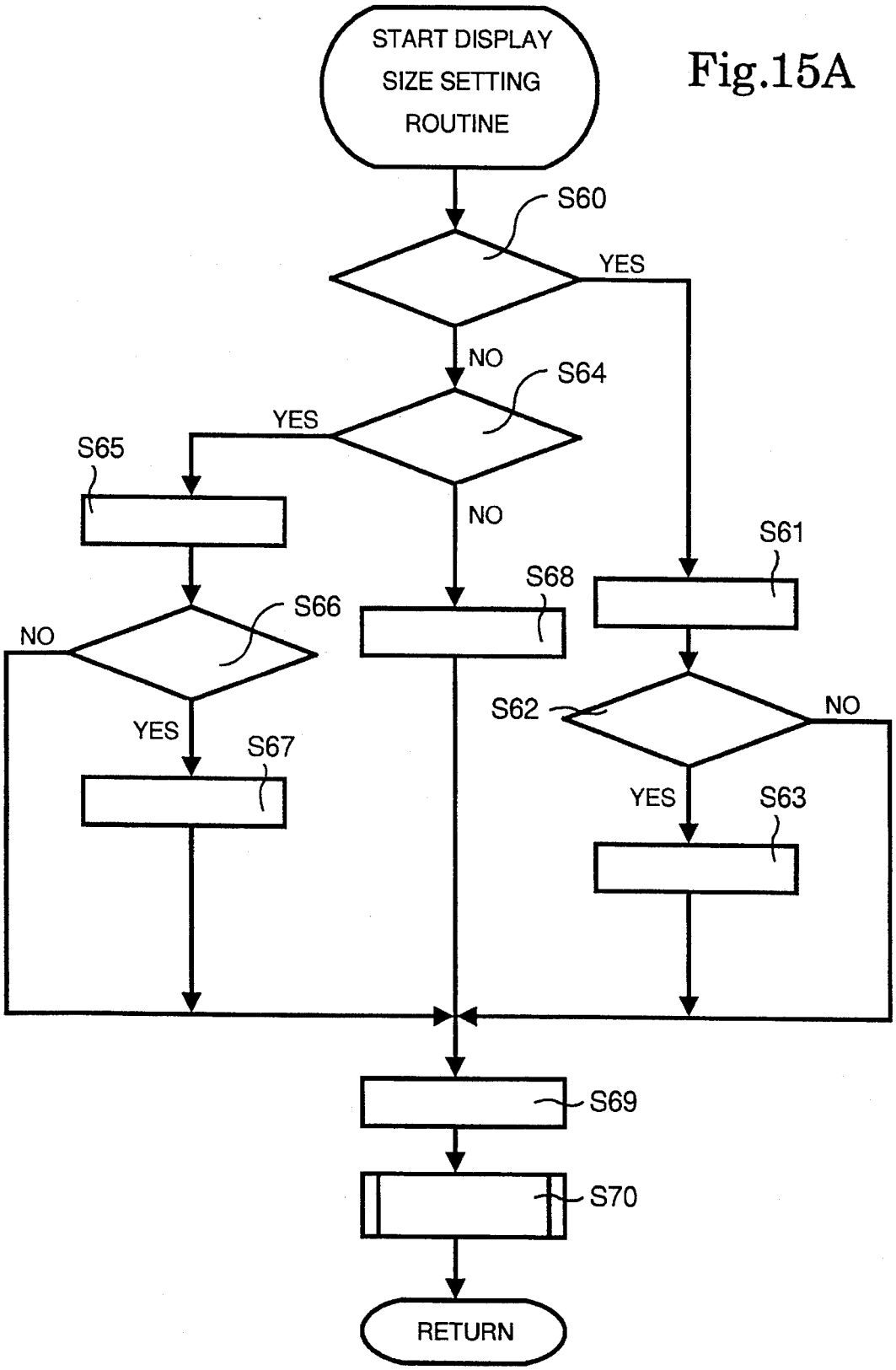
FIG. 15A is a flowchart of the display size setting routine shown in FIGS. 10A and 10B.

Next, the display image data generation routine (Step 36) will be explained with reference to FIGS. 14A, 14B.

Initially, the display character size is calculated from the print character size SZ included in the format data that has been loaded to the working memory 69 in Step 34 and the display scale factor R based on the table TB4 (S50). The index address of the CGROM 53 where dot pattern data of characters of the relevant character size are stored is fetched based on the display character size and the search table (S51). The font memory address, i.e., the starting address in CGROM 53 for that character is fetched based on the index address and the index table (S52). Dot pattern data stored at the font memory address of the CGROM 53 is read out and loaded to the working memory 69 (S53).

Finally, the dot pattern data is read out of the working memory 69 and loaded to the display data buffer 64 at the position indicated by the character layout data held in the layout information memory 63 (S54). The control routine terminates, and the control sequence returns to Step S37 of the print image display routine.

Returning to Step S38, if the search address, i.e., the sum of the start address pointer SP and the doubled DC value, coincides with the end address pointer EP as a result of Step S37 (S38: yes), the display dot image data that has been developed in the display data buffer 64 is displayed on the display screen 22 (S39). The control routine terminates, and the control sequence returns to Step S6 of the main routine.

Next, when the operation of the print key is detected by the main routine (S15: yes), the tape printing routine (S16) is executed as follows. The print format data and character codes are read out of the text memory 61 sequentially, dot pattern data of the characters is read out of the CGROM 53 based on the search table and index table, and the data is merged sequentially while being developed in the print data buffer 65. The print dot pattern data is delivered to the printing mechanism PM by which the characters are printed on the print tape 19. Thereafter the control sequence returns to step S5.

When the operation of a key other than display size set key, format set key, text enter key and print key is detected by the main routine (S17: no), a corresponding process is carried out (S17). Thereafter, the control sequence returns to Step S5 of the main routine.

Figure 25:
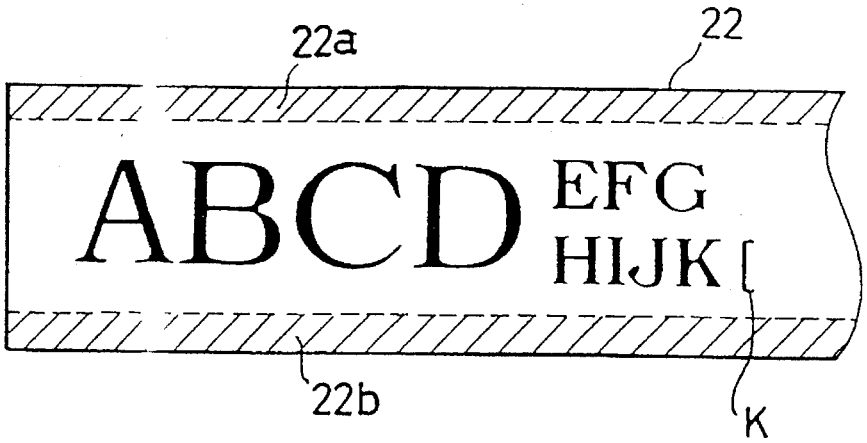
FIG. 25 is a diagram showing an example of a display for the 9-mm tape width.

FIGS. 20 through 24 show examples of displays for a partial text "ABCD" of the text data entered to the text memory 61 shown in FIG. 18 that is to be printed on tapes having widths of 24, 18, 12, 9 and 6 mm, respectively, with the display zone pattern number P=1 and the normal display scale factor being applied. FIG. 25 shows an example of a display for the complete text "ABCD EFG HIJK" held in the text memory 61, in which case portions "EFG" and "HIJK" are displayed on two lines. Indicated by K is the cursor.

Figure 17A:
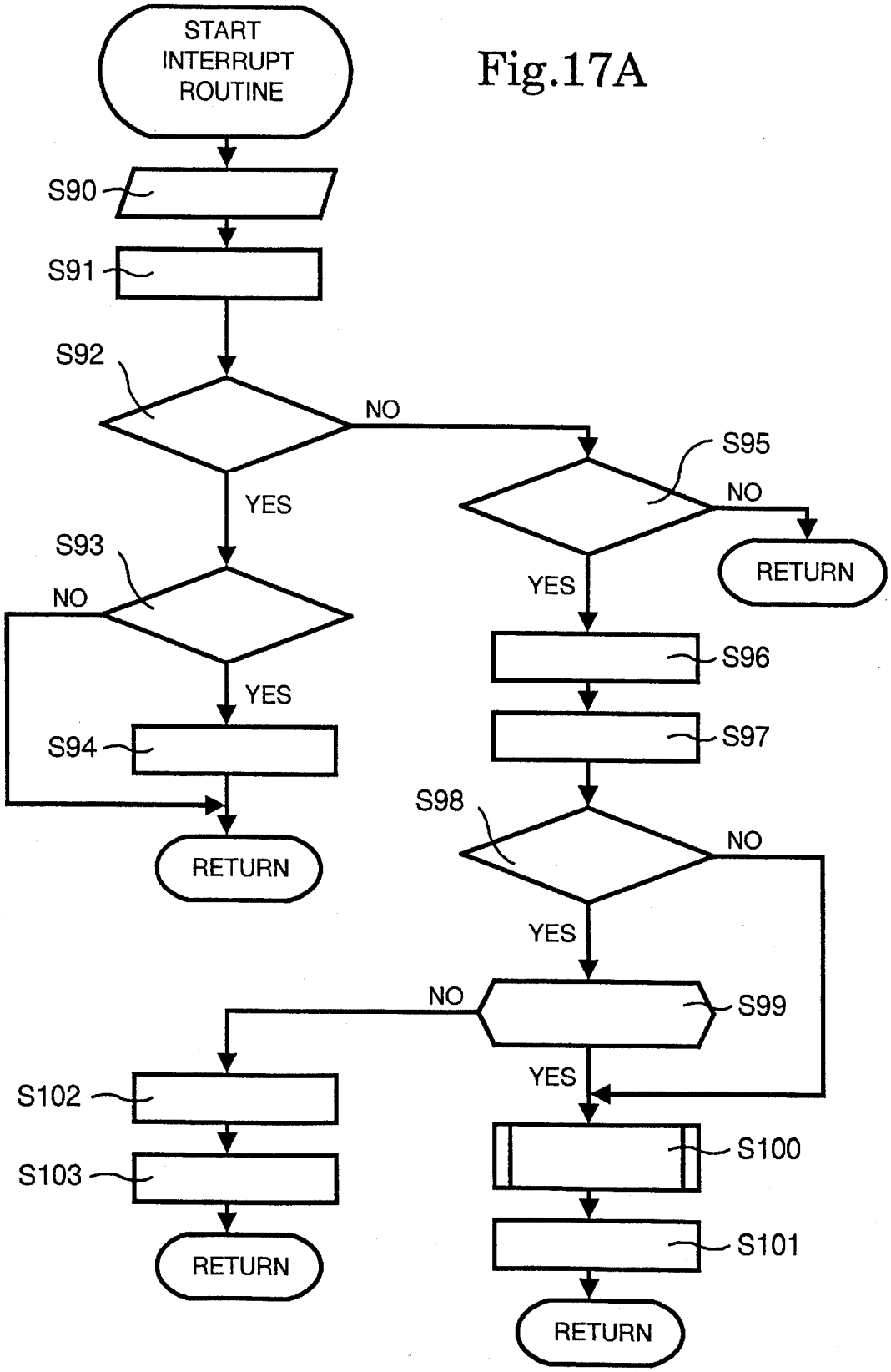
FIG. 17A is a flowchart of display switching control at the replacement of the tape cassette.

Next, display switching control at the replacement of tape cassette CS during the entry of text data for one text will be explained with reference to the flowchart of FIGS. 17A, 17B. This control is carried out by the interrupt routine which is executed at a certain short-time interval during the execution of the main routine.

Initially, the cassette signal from the cassette sensor 42 and the key operation signal are tested (S90) and the tape width is calculated based on the cassette signal in the same manner as described previously (S91). Then the flag TF is tested to see if it is "0". If it is "0", indicating that the tape cassette CS is left unchanged, the control sequence proceeds to Step S93 for testing whether the tape width is altered. If the tape width is found unchanged (S93: no), the control sequence returns to the main routine, or if the tape width is found to be altered (S93: yes), the flag TF is set to "1" (S94) and thereafter the control sequence returns to the main routine.

In the next interrupt period, the flag TF is found to be "1" (S92: no), and the control sequence proceeds to Step S95 for testing whether any key operation is detected. If a key operation is not detected, the control sequence returns to the main routine.

In a subsequent interrupt period, if the flag TF is found to be "1" and a key operation is detected (S95: yes), the control sequence proceeds to Step S96. Data of an altered tape width is loaded to the tape width memory 66, and the width Wc of image display zone 22*c* is calculated from the tape width based on the table TB5 (S96). Data of the print character size SZ included in the default format data in the text memory 61 is revised to the print character size corresponding to the tape width in the same manner as Step S3 explained previously (S97).

Next, if any format data is found altered (S98: yes), it is tested whether the number of print lines and print character size among the altered format data are applicable to the revised tape width in the tape width memory 66 (S99). If these items are found to be applicable, the display zone alteration routine for changing the display dot image data of the upper and lower cutoff zones 22*a* and 22*b*, so that the image display zone 22*c* matches with the tape width, is executed (S100) and the flag TF is reset to "0" (S101). Thereafter, the control sequence returns to the main routine.

If the alteration of format data is not detected (S98: no), the control sequence proceeds to Step S100, skipping Step S99. The display zone alteration routine of Step S100 is identical to the process of Steps S84–S87 explained previously.

In case the altered format items are found inapplicable (S99: no), the alarm buzzer 43 is activated (S102), and a message "Retry Format Alteration" for example, is displayed (S103). Thereafter, the control sequence returns to the main routine.

In this manner, after the tape cassette CS has been replaced with another one having a different tape width, the print image on the display screen 22 does not change immediately. Instead, after any key has been operated following the replacement of the tape cassette CS, the print character size SZ of the default format data and data of the image display zone width are changed to match the new tape width, the display character size is changed to match the print character size, and the print image on the display screen 22 is altered in accordance with the new display character size.

The effectiveness of the foregoing display control included in the tape print control is as follows. According to this control, the print character size is basically set to be virtually proportional to the tape width and the display character size is set to be virtually proportional to the print character size. Consequently, the display character size is virtually proportional to the tape width, enabling the user to anticipate the print result in relation to the tape width, and the usefulness of the apparatus is enhanced.

The print image display zone 22*c* is formed in the central portion of the display screen 22 by being defined by the upper and lower cutoff zones 22*a* and 22*b* that are displayed distinctively and characters are displayed as a print image in the zone 22*c*. Consequently, the user can anticipate more clearly the print result of characters of the tape in relation with the tape width. The apparatus has enhanced operability for the entry of text data and the erroneous setting of the print character size can be prevented.

Specifically, the user is allowed to choose one of five display patterns for the upper and lower cutoff zones 22*a* and 22*b* stored in the table TB5 by using the display zone alter key. These display patterns include hatched areas and shaded areas providing a clear distinction from frame lines or the like that are entered as text data.

It is possible to specify the display scale factor for the enlargement of displayed characters through the operation of the display size set key so that characters to be printed on a narrow tape or characters entered on two or more lines are displayed by being enlarged and the usefulness of the apparatus is enhanced.

At the alteration of tape width, the content of the display is changed after any key has been operated following the replacement of tape cassette CS. Consequently, the display screen is prevented from being disturbed due to the switching of the cassette signal at the replacement of the tape cassette CS and the reliability and operability of the apparatus is enhanced.

The following describes the correspondence between the constituents of the foregoing embodiment and the means stated in the appended claims.

The data memory means compares to the text memory 61 in the RAM 60, the font memory means compares to the CGROM 53; the display data buffer compares to the display data buffer 64 in the RAM 60; the tape width detection means compares to the cassette sensor 42, tabs 20 and table TB1; the first display data generation means compares to the controller C (particularly tables TB3–TB6 and flowcharts of FIGS. 10A, 10B, FIGS. 11A, 11B, FIGS. 12A, 12B and FIGS. 16A, 16B); the second display data generation means compares to the controller C (particularly tables TB3 and TB4 and flowcharts of FIGS. 10A, 10B, FIGS. 11A, 11B, and FIGS. 14A, 14B); and the line type setting means compares to the display zone alter key and the controller C (particularly table TB6, pattern memory 68 and the flowchart of FIGS. 16A, 16B).

While the invention has been shown and described for its specific embodiment, it will be apparent to those skilled in the art that changes and modifications can be made within the spirit of the invention.

For example, an optical detection means may be used to measure the tape width directly on the tape running path in place of the cassette sensor 42. A display CGROM and a print CGROM may be used individually, in place of the CGROM 53. A large thermal print head may be used to enable the application to tapes wider than 24 mm. A display screen which covers the largest tape width may be used so that a print image of characters is displayed in real scale. A keyboard having Kana character keys may be used so that Japanese texts can be printed on the tape. The number of print lines may be set automatically based on the entry of CR code so that the number of print lines is eliminated from the default format data held in the text memory 61.

What is claimed is:

1. A tape printing apparatus, comprising:

input means for entering alphanumeric and symbolic characters and various commands;

data memory means for storing data of entered characters;

display means including a display screen for displaying characters;

font memory means for storing dot pattern data of many characters;

a display data buffer for storing display image data to be displayed on said display screen;

display control means for controlling said display means in response to the display image data read out of said display data buffer;

printing means for printing characters on a tape as a printing medium; and a tape cassette having a tape stored therein is mounted detachably on said printing means, wherein said apparatus further includes:

tape width detection means for detecting the tape width of the tape stored in said tape cassette;

first display data generation means which receives data of the tape width detected by said tape width detection means, generates display image data for displaying distinctively an upper cutoff zone and lower cutoff zone in the upper and lower sections of said display screen thereby to set up an effective display zone having a width proportional to the tape width in the central portion of said display screen, and develops the image data in said display data buffer; and second display data generation means which reads dot pattern data out of said font memory means for the characters held in said data memory means, generates display image data for displaying a print image of the characters in the effective display zone, and stores the display image data in said display data buffer.

2. The tape printing apparatus according to claim 1, wherein said first display data generation means generates display image data for displaying the upper cutoff zone and lower cutoff zone in the form of hatched or shaded areas.

3. The tape printing apparatus according to claim 1, wherein said first display data generation means generates display image data for displaying the upper cutoff zone and lower cutoff zone in the form of border lines.

4. The tape printing apparatus according to claim 3, further comprising line-type setting means for setting the type of the border lines.

5. The tape printing apparatus according to claim 1, further comprising scaling means for changing the size of the display zone relative to the upper cutoff zone and lower cutoff zone displayed on said display.

6. The tape printing apparatus according to claim 5, wherein said scaling means is operable when said tape has a width less than or equal to a predetermined size.

7. The tape printing apparatus according to claim 1, further comprising a print data generation means for creating print data for printing by the printing means on the tape.

8. The tape printing apparatus as claimed in claim 1, wherein the upper cutoff zone, display zone and lower cutoff zone extend horizontally as viewed by an observer.

9. The tape printing apparatus according to claim 7, wherein the tape width detection means determines a cassette width which defines a width of the tape contained therein.

10. The tape printing apparatus as claimed in claim 9, wherein the display zone generated by said first display data generation means and the character data displayed therein generated by the second display data generation means are scaled so as to present a representation of the character data as printed on the tape.

11. A tape printing apparatus, comprising:

input means for inputting alphanumeric and symbolic character data and various commands;

a data memory for storing input character data;

a display;

a controller for controlling operation of the tape printing apparatus;

a printing unit for printing the input character data on a tape print medium;

a tape cassette containing said tape print medium removably mounted on the printing unit;

cassette detecting means for detecting a size of the tape cassette mounted on the printing unit;

first display generation means for dividing the display into three parallel sections including a center section having a width proportional to the width of the tape print medium; and second display generation means for generating character data for display in the center section of the display, the displayed character data being proportional to the character data printed on the tape print medium.

12. The tape printing apparatus according to claim 11, further comprising scaling means for changing the size of the center section relative to the other two sections displayed on said display.

13. The tape printing apparatus according to claim 12, wherein said scaling means is operable when said tape print medium has a width less than or equal to a predetermined size.

14. The tape printing apparatus according to claim 11, further comprising a print data generation means for creating print data for printing by the printing unit on the print medium.

15. The tape printing apparatus as claimed in claim 11, wherein said three parallel sections extend horizontally as viewed by an observer.

16. The tape printing apparatus according to claim 15, wherein the sections formed on either side of the center section of the display have the form of hatched or shaded areas.

17. The tape printing apparatus according to claim 15, wherein the sections on either side of the center section of the display are separated from the center section by border lines.

18. The tape printing apparatus according to claim 17, further comprising line setting means for creating the type of border lines.

19. The tape printing apparatus according to claim 14, wherein the detecting means determines a cassette width which defines a width of the tape print medium contained therein.

20. The tape printing apparatus as claimed in claim 19, wherein the center section generated by said first display generation means and the character data displayed therein generated by the second display generation means are scaled so as to present a representation of the character data as printed on the tape print medium.

* * * * *